US009351525B2

(12) United States Patent
Best et al.

(10) Patent No.: US 9,351,525 B2
(45) Date of Patent: May 31, 2016

(54) COMPRESSION SHIRT WITH ROLL-OVER SLEEVE

(75) Inventors: William Best, Orono, MN (US); Bastien Jourde, Montreal (CA)

(73) Assignee: Shock Doctor, Minnetonka, MN (US)

( * ) Notice: Subject to any disclaimer, the term of this patent is extended or adjusted under 35 U.S.C. 154(b) by 40 days.

(21) Appl. No.: 13/278,488

(22) Filed: Oct. 21, 2011

(65) Prior Publication Data

US 2012/0180181 A1 Jul. 19, 2012

Related U.S. Application Data

(60) Provisional application No. 61/455,469, filed on Oct. 21, 2010.

(51) Int. Cl.
*A41D 27/10* (2006.01)
*A41D 13/08* (2006.01)

(52) U.S. Cl.
CPC ..... *A41D 13/08* (2013.01); *A41D 27/10* (2013.01); *A41D 2400/42* (2013.01); *A41D 2400/82* (2013.01); *A41D 2600/10* (2013.01)

(58) Field of Classification Search
CPC ..... A41D 27/10; A41D 2400/42; A41D 2400/82; A41D 2600/10
USPC ..... 2/115, 122, 125
See application file for complete search history.

(56) References Cited

U.S. PATENT DOCUMENTS

| | | | | |
|---|---|---|---|---|
| 3,122,753 | A * | 3/1964 | Smith | 2/94 |
| 4,783,858 | A * | 11/1988 | Chevalier | 2/90 |
| 5,388,271 | A * | 2/1995 | Sessoms | 2/115 |
| 7,636,950 | B2 * | 12/2009 | Melhart et al. | 2/69 |
| 7,748,056 | B2 * | 7/2010 | Mickle | 2/115 |
| 2004/0016041 | A1 * | 1/2004 | Uno et al. | 2/113 |
| 2006/0053526 | A1 * | 3/2006 | Beland et al. | 2/115 |

* cited by examiner

*Primary Examiner* — Katherine Moran
(74) *Attorney, Agent, or Firm* — Faegre Baker Daniel, LLP

(57) ABSTRACT

One embodiment of the invention is a shirt comprising a body portion for receiving a user's torso and first and second sleeves attached to the body portion. The first and second sleeves each have an elbow region including at least a first anti-slip pattern and a cuff region including at least a second anti-slip region. In use, an elbow pad may be disposed over an upper region of one sleeve such that an inner surface of the elbow pad contacts the first anti-slip pattern. A lower sleeve portion including the cuff region may be folded over the elbow pad such that the second anti-slip pattern contacts an outer surface of the elbow pad.

16 Claims, 6 Drawing Sheets

COMPRESSION SHIRT WITH ROLL-OVER SLEEVE

CROSS-REFERENCE TO RELATED APPLICATIONS

This application claims the benefit under 35 U.S.C. 119(e) of U.S. provisional application 61/455,469 entitled "COMPRESSION SHIRT WITH DUAL ELASTICITY PERFORMANCE," which is hereby incorporated by reference in its entirety.

BACKGROUND

For many athletic events such as hockey, elbow pads are worn over a long-sleeve compression garment or similar undergarment to protect an athlete's elbow and arm. The elbow pads are worn over the long-sleeve garment because the shirt sleeves are designed to compress to an athlete's arms. However, a lack of friction between the shirt sleeve and the inner surface of the elbow pads and/or the shirt sleeve and the user's arm often causes the pad to slip relative to the user's elbow and arm. This slippage may cause discomfort and increase the chance of injury.

SUMMARY

One embodiment of the invention is a shirt comprising a body portion for receiving a user's torso and first and second sleeves attached to the body portion. The first and second sleeves each have an elbow region including at least a first anti-slip pattern and a cuff region including at least a second anti-slip region. In use, an elbow pad may be disposed over an upper region of one sleeve such that an inner surface of the elbow pad contacts the first anti-slip pattern. A lower sleeve portion including the cuff region may be folded over the elbow pad such that the second anti-slip pattern contacts an outer surface of the elbow pad.

Another embodiment is a shirt comprising a body portion for receiving a user's torso and first and second sleeves attached to the body portion. The first and second sleeves each include an upper sleeve portion and a lower sleeve portion attached to the upper sleeve portion. The lower sleeve portion is comprised of a first material that has a greater degree of elasticity than a second material that comprises the upper sleeve portion.

DETAILED DESCRIPTION

Figure 1:
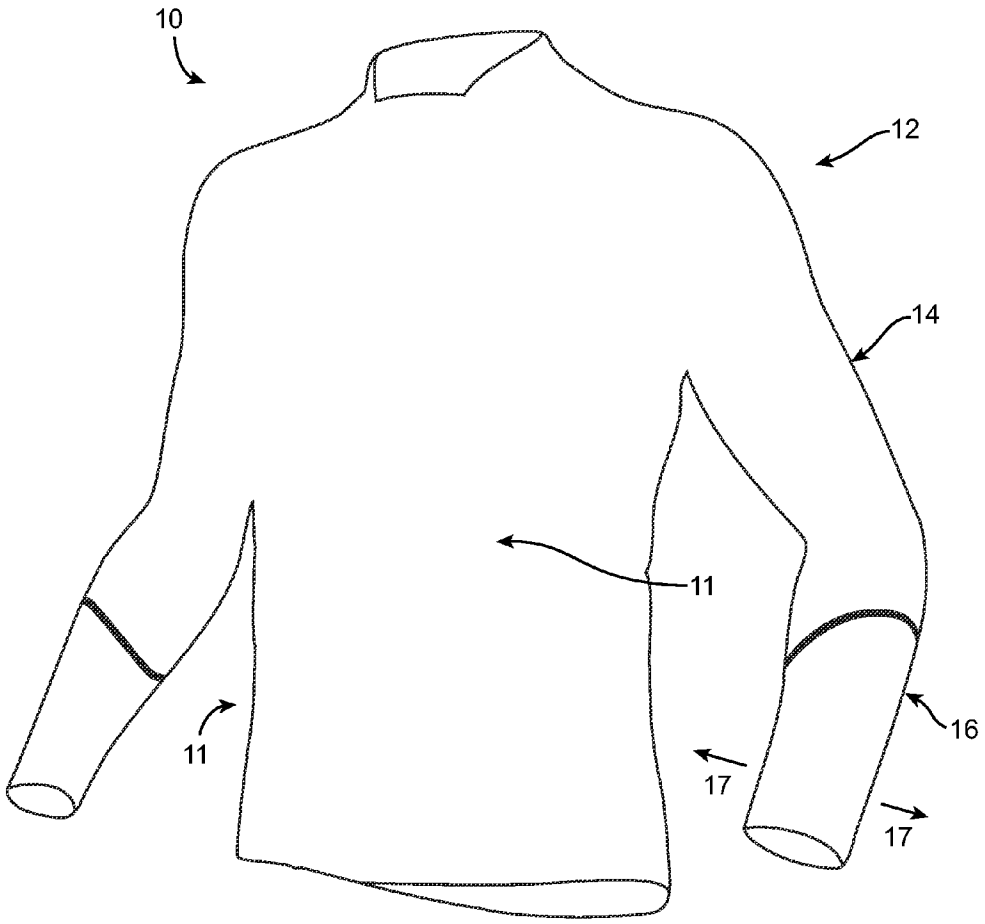
FIG. 1 is a perspective view of a shirt according to an embodiment of the present invention.

FIG. 1 is a perspective view of a compression shirt garment 10 according to one embodiment of the present invention, which includes a torso 11 and a sleeve 12 with an upper sleeve portion 14 and a lower sleeve portion 16 attached to the upper sleeve portion 14.

The garment 10 may be formed from a conventional compression material such as "Lycra" or a similar material known to compress against a user's body. The upper sleeve portion 14 may be formed from the same material as the garment 10 so that it compresses against a user's arm. In one embodiment, the lower sleeve portion 16 may be formed to have a greater degree of expansion relative to the user's arm than the upper sleeve portion 14 along an axis 17 that is transverse to a longitudinal axis of the sleeve. For example, lower sleeve portion 16 may be formed from a material that allows for a higher degree of stretchability and/or elasticity along axis 17 than the material that forms the upper sleeve portion 14. In particular, the lower sleeve portion 16 may be formed from a compression material that has a higher degree of elasticity or stretchability than the compression material that forms the upper sleeve portion 14. In another example, the lower sleeve portion 16 is formed from a material with a different fiber alignment than the material that forms the upper sleeve portion 14. In a further embodiment, the lower sleeve portion 16 includes a gusset of material that has a greater degree of expansion relative to the user's arm.

Figure 2:
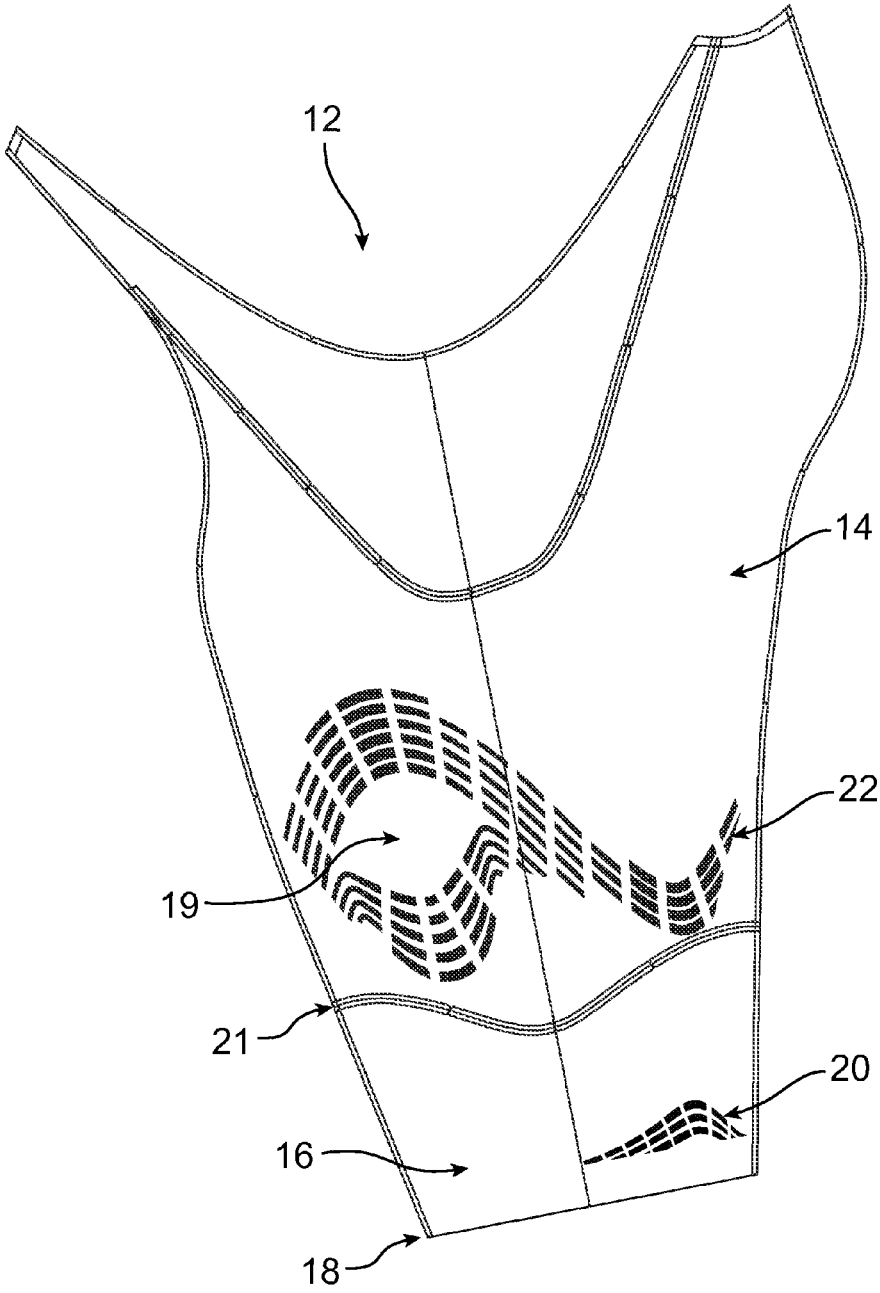
FIG. 2 is a top view of a flattened shirt sleeve according to an embodiment of the present invention.

FIG. 2 is a flattened view of the sleeve 12, essentially as it would look prior sewing the sleeve to the torso 11. The sleeve includes a cuff region 18, an elbow region 19, a lower anti-slip pattern 20 in the cuff region 18, an upper anti-slip pattern 22 in the elbow region 19 and a seam 21 attaching the upper sleeve portion 14 to the lower sleeve portion 16. The lower anti-slip pattern 20 and upper anti-slip pattern 22 may be used to secure a separate elbow pad as further described with respect to FIGS. 3A-3C. A variety of different anti-slip patterns (e.g., bands, lines, dashes, dots) and shape configurations may be used. In the illustrated embodiment, the upper anti-slip pattern 22 includes a circular pattern generally around the elbow region 19. In other embodiments, the upper anti-slip pattern 22 may include a pattern that extends around some or all of the circumference of the sleeve 12. As illustrated, the lower anti-slip pattern is in the form of a wave-like pattern. In other embodiments, the lower anti-slip pattern 20 may extend around some or all of cuff region 18. In one embodiment, only the lower anti-slip pattern 20 is included.

The lower anti-slip region 20 and upper anti-slip pattern 22 may be formed from a material that reduces slippage when the anti-slip pattern contacts an elbow pad. For example, the anti-slip patter may reduce the coefficient of friction between the sleeve 12 and the elbow pad compared to portions of the sleeve that do not include the anti-slip pattern. In one embodiment, at least one of the anti-slip regions may comprise a polymer material such as a silicone rubber or resin material that is printed onto or impregnated into the sleeve fabric. In another embodiment, at least one of the anti-slip regions may include a raised pattern such as a series of rubber ribs that reduces slippage. In a further embodiment, at least one of the patterns may comprise a reusable adhesive material.

Figure 3C:
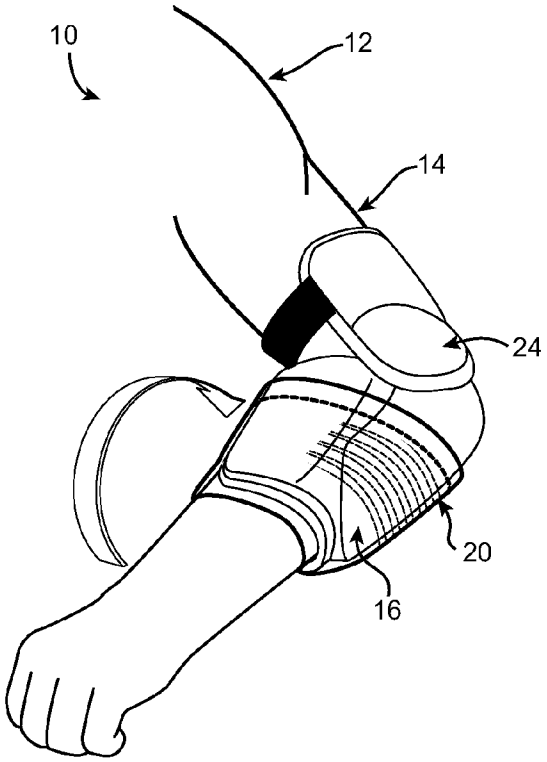
FIGS. 3A-3C show an embodiment of the present invention in use.
Figure 3B:
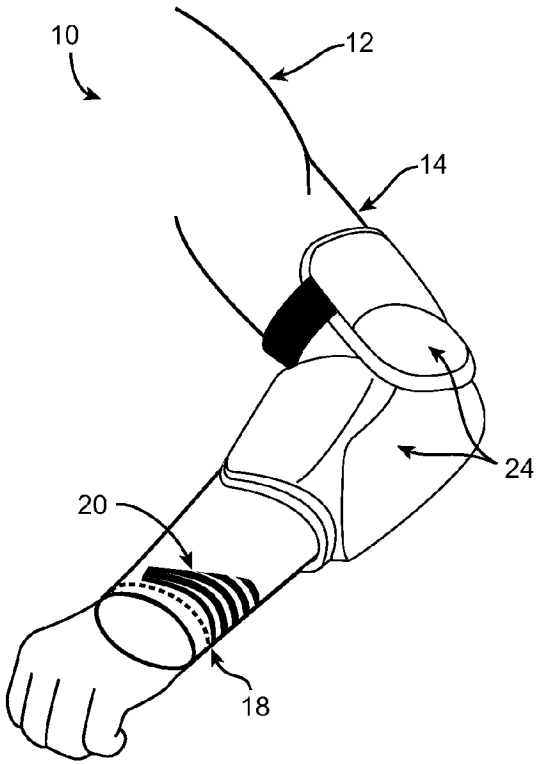
Figure 3A:
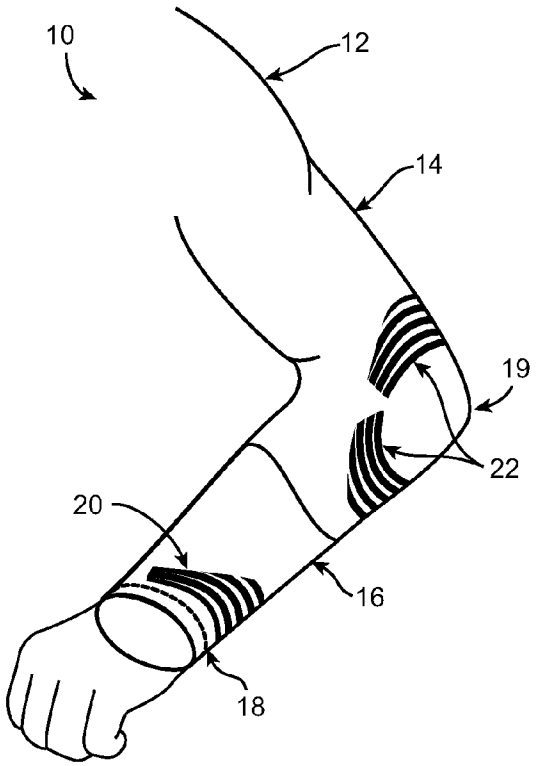

As further shown in FIGS. 3A-3C, an elbow pad 24 may be worn by a user over the sleeve 12 of the compression garment 10. The elbow pad 24 is positioned over the upper sleeve portion 14 so that an inner surface of the elbow pad 24 is in contact with upper anti-slip pattern 22 to reduce sliding of the elbow pad relative to the sleeve. The lower sleeve portion 16 is configured such that a user can fold the lower sleeve portion 16 over the elbow pad 24. As previously noted, the lower sleeve portion 16 may be configured to have a higher degree of expansion than the upper sleeve portion 14 so that it can be folded over the elbow pad 24 to further secure the elbow pad 24. Once the lower portion 16 is folded, the lower anti-slip pattern 20 contacts an outside surface of the elbow pad 24 to reduce movement of the elbow pad 24 relative to the lower sleeve portion 16. Cuff 18 may serve to secure the sleeve over the elbow pad 24. For example, cuff 18 may include an elastic band or a strap that provides additional securement.

One benefit of the sleeve 12 described herein is that it can be used with virtually any elbow pad 24, and does not require any additional anti-slip components on the elbow pad 24.

Figure 4:
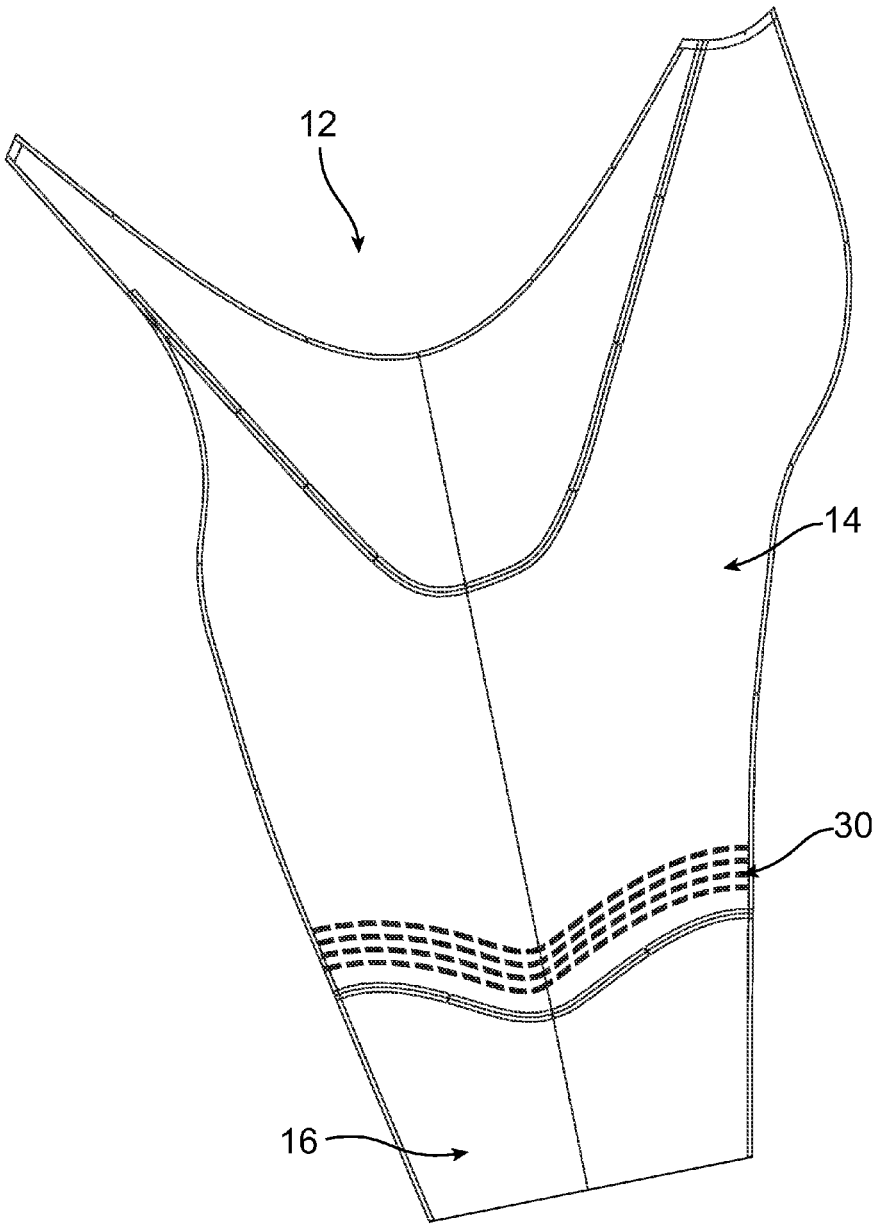
FIG. 4 is a top view of a flattened shirt sleeve according to another embodiment of the present invention.

FIG. 4 is an inside-out flattened view of the sleeve 12 according to another embodiment, which includes an optional inside anti-slip pattern 30 disposed on an inner surface of the sleeve 12 such that it contacts the skin. The inside anti-slip pattern 30 may be formed from any of the materials and formed in any of the patterns previously described. Additionally, inside anti-slip pattern 30 may be used as an alternative or in addition to the anti-slip patterns disposed on the outside surface of the sleeve 12.

Figure 5:
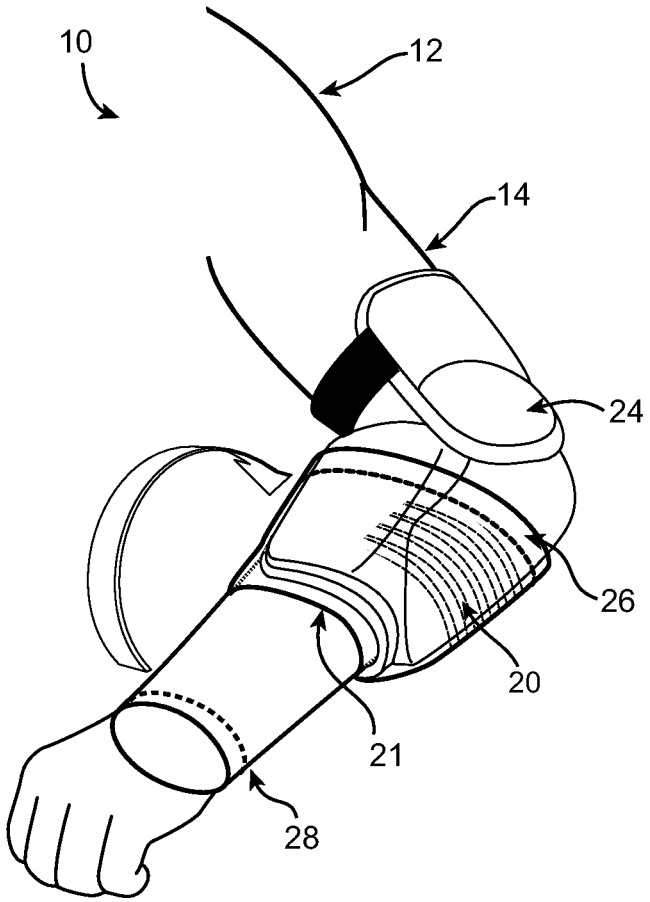
FIG. 5 shows another embodiment of the present invention in use.

In a further embodiment shown in FIG. 5, the lower sleeve portion 16 includes an outer sleeve 26 formed as described above, and an inner sleeve 28 that may be formed from the same material as the remainder of the garment. The outer sleeve 26 and the inner sleeve 28 may be joined with the upper sleeve portion 14 at a seam 21. In this embodiment, the outer sleeve 26 may be extended over the elbow pad without exposing the user's arm.

Figure 6:
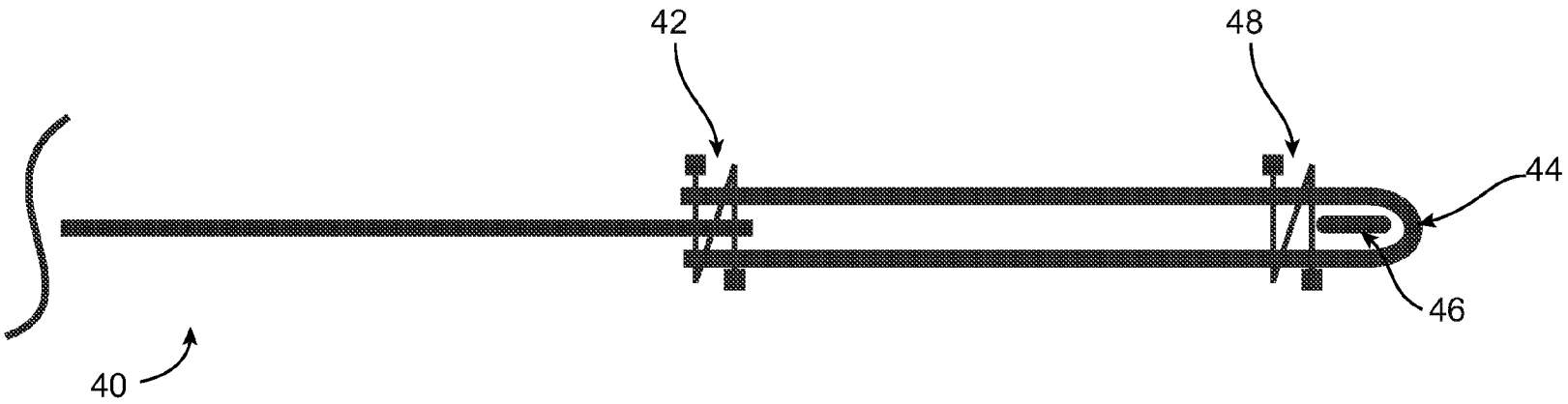
FIG. 6 is a schematic cross-section of a shirt sleeve according to an embodiment of the present invention.

FIG. 6 is a schematic, longitudinal cross-sectional view of sleeve a 40 showing one embodiment in which lower sleeve portion 16 includes a double layer of fabric 44 disposed between proximal seam 42, which attached to upper sleeve portion 14, and distal seam 48. The cuff 18 includes an elastic ring 46 held in place by the distal seem 48. The sleeve 12 is folded over at the proximal seam 42 to secure the elbow pad.

The invention claimed is:

1. A shirt comprising:

a body portion for receiving a user's torso;

first and second sleeves attached to the body portion adapted to receive a user's arms, each sleeve including an outer surface, each sleeve comprising:

an elbow region including a first anti-slip pattern configured to contact an inner surface of an elbow pad;

a cuff region including a second anti-slip pattern; and a predefined fold line comprising a seam disposed between the elbow region and the cuff region fully extending around the circumference of each sleeve on the outer surface, each sleeve configured to fold at least partially over the elbow pad at the predefined fold line such that the second anti-slip pattern contacts an outer surface of the elbow pad in order to secure the elbow pad in position.

2. The shirt of claim 1 wherein each sleeve comprises an upper sleeve portion and a lower sleeve portion, wherein the lower sleeve portion has a greater degree of expansion than the upper sleeve portion along a transverse axis of the sleeve.

3. The shirt of claim 2 wherein the lower sleeve portion has a greater degree of elasticity than the upper sleeve portion along a transverse axis of the sleeve.

4. The shirt of claim 2, wherein the upper sleeve portion comprises a first material and the lower sleeve portion comprises a second material.

5. The shirt of claim 2, wherein the seam divides the upper sleeve portion from the lower sleeve portion.

6. The shirt of claim 1 wherein at least one of the anti-slip patterns comprises a raised pattern.

7. The shirt of claim 1 wherein at least one of the anti-slip patterns comprises a laminate material.

8. The shirt of claim 1 wherein at least one of the anti-slip patterns comprises a printed material.

9. The shirt of claim 1 wherein at least one of the anti-slip patterns comprises a polymer material.

10. The shirt of claim 1 wherein at least one of the anti-slip patterns comprises a silicone material.

11. The shirt of claim 1 wherein at least one of the anti-slip patterns comprises an adhesive material.

12. The shirt of claim 1 further comprising an inner anti-slip pattern disposed on an inside surface of the sleeve.

13. The shirt of claim 1 further comprising an elastic band disposed in the cuff region configured to be stretched over and be disposed over the elbow pad to provide additional securement of the elbow pad in place when the sleeve is folded.

14. The shirt of claim 1 wherein each sleeve includes an upper sleeve member and a lower sleeve member, and wherein the lower sleeve member includes an inner sleeve member and an outer sleeve member that are joined at a proximal seam with the upper sleeve member.

15. A shirt comprising:

a body portion for receiving a user's torso;

a first sleeve attached to the body portion adapted to receive a user's arm; and a second sleeve attached to the body portion adapted to receive a user's other arm;

wherein each sleeve includes:

an upper sleeve portion;

a lower sleeve portion attached to the upper sleeve portion; and a predefined fold line comprising a seam fully extending around the circumference of each sleeve between the upper sleeve portion and the lower sleeve portion;

wherein the lower sleeve portion is comprised of a first material that has a greater degree of elasticity than a second material that comprises the upper sleeve portion, the lower sleeve portion being configured such that the lower sleeve portion can be folded and stretched over an elbow pad to help secure the elbow pad in place.

16. The shirt of claim 15, wherein the first material comprises a first composition and the second material comprises a second composition.

* * * * *